US007775164B2

(12) United States Patent
Refsum

(10) Patent No.: US 7,775,164 B2
(45) Date of Patent: Aug. 17, 2010

(54) COMBINATION TABLE

(76) Inventor: Bjorn Refsum, Fjellgata 73, Alesund (NO) N-6007

( * ) Notice: Subject to any disclaimer, the term of this patent is extended or adjusted under 35 U.S.C. 154(b) by 505 days.

(21) Appl. No.: 10/483,895

(22) PCT Filed: Jul. 11, 2002

(86) PCT No.: PCT/NO02/00255

§ 371 (c)(1),
(2), (4) Date: Jul. 26, 2004

(87) PCT Pub. No.: WO03/005857

PCT Pub. Date: Jan. 23, 2003

(65) Prior Publication Data

US 2004/0237857 A1 Dec. 2, 2004

(30) Foreign Application Priority Data

Jul. 13, 2001 (NO) ..... 20013495

(51) Int. Cl.
*A47B 3/00* (2006.01)

(52) U.S. Cl. ..... 108/115; 108/163

(58) Field of Classification Search ..... 108/115, 108/116, 128, 162, 170, 163, 109, 107, 164; 211/132.1, 133.2, 133.3, 134, 208, 207, 190, 211/119.003, 119.006
See application file for complete search history.

(56) References Cited

U.S. PATENT DOCUMENTS 1,052,516 A * 2/1913 Ringer ..... 108/109
1,080,203 A * 12/1913 Dungan ..... 108/107
1,136,245 A * 4/1915 Leland ..... 108/109
1,860,103 A * 5/1932 Kusterle ..... 5/11
2,005,593 A * 6/1935 Sandberg et al. ..... 108/109
2,280,913 A 4/1942 Hummel et al.
2,496,221 A * 1/1950 Koch ..... 211/134
2,830,303 A * 4/1958 Sandock ..... 5/11
2,873,458 A * 2/1959 Adamson ..... 5/11
3,322,077 A * 5/1967 Kovacik ..... 108/115
3,527,174 A * 9/1970 Lay ..... 108/115
3,848,277 A * 11/1974 Reguitti ..... 5/11
3,858,530 A * 1/1975 Jaffee et al. ..... 108/107

(Continued)

FOREIGN PATENT DOCUMENTS

DE 601610 8/1934

(Continued)

OTHER PUBLICATIONS

Abstract of Korean Publication No. 1020010036536A dated May 7, 2001.

(Continued)

*Primary Examiner*—José V Chen
(74) *Attorney, Agent, or Firm*—Kolisch Hartwell, P.C.

(57) ABSTRACT

A combination table (1) arranged for use as a baby changing table or a desk or a partition, including either two vertical side members (2) and one horizontal table top (5) and at least one horizontal shelf (7); or two vertical side members (2) and one horizontal table top (5) and one horizontal crossbeam (10) and alternatively one or more shelves (7) mounted between the side members (2); or at least two vertical side members (2) mounted together by its vertical edges.

10 Claims, 5 Drawing Sheets

U.S. PATENT DOCUMENTS

| | | | | | |
|---|---|---|---|---|---|
| 3,908,562 | A | * | 9/1975 | Wittschen | 108/163 |
| 4,728,069 | A | | 3/1988 | Semcer | |
| 4,972,783 | A | * | 11/1990 | Crissman et al. | 108/107 |
| 4,997,151 | A | * | 3/1991 | Pai | 108/115 |
| 5,361,432 | A | * | 11/1994 | Shamie | 5/11 |
| 5,592,887 | A | * | 1/1997 | Teng | 108/163 |
| 5,845,793 | A | * | 12/1998 | Pan | 108/163 |
| 5,904,104 | A | * | 5/1999 | Yu | 108/115 |
| 6,049,926 | A | | 4/2000 | Amaral | |
| 6,240,855 | B1 | * | 6/2001 | Pirkl et al. | 108/115 |
| 6,247,770 | B1 | * | 6/2001 | Glass | 108/107 |
| D454,726 | S | * | 3/2002 | McDaniel et al. | D6/465 |
| 6,698,364 | B2 | * | 3/2004 | Welch et al. | 108/115 |
| 6,752,090 | B2 | * | 6/2004 | Schenker et al. | 108/115 |
| 6,817,302 | B2 | * | 11/2004 | Norstad | 108/115 |
| 6,994,034 | B2 | * | 2/2006 | Chang | 108/115 |
| 6,997,115 | B2 | * | 2/2006 | Lockwood et al. | 108/115 |

FOREIGN PATENT DOCUMENTS

| | | |
|---|---|---|
| DE | 20018146 | 2/2001 |
| EP | 0 174 500 | 3/1986 |
| FR | 910026 | 5/1946 |
| FR | 1019031 | 5/1950 |
| FR | 983591 | 6/1951 |
| JP | H08-256882 A | 10/1996 |
| SU | 1118348 | 10/1984 |

OTHER PUBLICATIONS

International Search Report, PCT/NO02/00255, Oct. 11, 2002.

* cited by examiner

COMBINATION TABLE

BACKGROUND OF THE INVENTION

The present invention concerns a combination table with possibilities of variation and which may be re-assembled in order to adapt to several uses.

PRIOR ART

From prior art, several baby changing tables in different forms are known, of which some may be collapsed in different ways. The advantage of collapsible baby changing tables is that they occupy little space when the table is not in use, especially if the available space where it is to be used is limited, for example in a bathroom, or when the table is to be kept or stored elsewhere.

Further, baby changing tables with integrated drawers, is wherein the upper part of the table contains the baby changing table top, which is often padded, and alternatively a bath tub is known. The nursing plate and the bath tub may be removed when the child is too old for the baby changing table, and an extra drawer and a top plate may be mounted so that the table becomes a chest of drawers which may be used in the children's room.

One problem with the earlier baby changing tables is that the flexibility with reference to the user has not always been in focus. Most of the functions have been directed towards saving space, and partly for extended use after the child has grown from the baby changing table. An extended use of a product, which the child only uses in a short period, such as in a period of 2 years for example, is important financially and in relation to space for parents of small children, who must often acquire a large number of products when they have a child. In this respect, a chest of drawers as mentioned above, is often not the primary need when the child no longer needs the baby changing table, as the child often already has a chest of drawers, a cupboard or a wardrobe. To use the drawers section of the baby changing table for clothes while it is used as a baby changing table, often in a bathroom, is often out of the question as the drawers are used for nappies and care products, or because of humidity in the room.

From FR 910026 a playpen is known, consisting of side pieces with horizontal bars wherein the side pieces may be used to transform the furniture into a table in different variations, a baby high chair and a bed, etc. The disadvantage with this solution is that all the furnitures requires the use of at least 3 side pieces which reduces the area of use for example in that only one side of the table may be used for sitting against. The weight is relatively high and as the side pieces are used as a playpen fence, the height of the side pieces is reduced. Consequently the baby changing table will have a height too low for a proper ergonomic working position. Further, the furniture constructed with the side pieces in FR 910026 have horizontal bars on which the child may climb, which will hinder an approval for use as furniture for children in many countries.

Today, most parents are very conscious of good ergonomics in furniture both at work and at home. To change a baby may be a demanding task where the person changing the child stands, lifts and turns the baby, and bends to find nappies, flannels, towels, paper, and clothes etc. for the baby. This is a routine which is repeated many times daily and may strain the body unfavourably by unfit working posture. There is therefore a need for baby changing tables which may be adapted both to the users working posture and the child's development, and which are steady and robust.

OBJECT OF THE INVENTION

The object of the invention is to supply a combination table which solves the above mentioned problems and rectifies the shortcomings of the prior solutions. Further, the object is to provide a combination table with simple construction, which has both possibilities of variation and several practical uses.

SHORT DESCRIPTION OF THE INVENTION

The object is attained by a combination table which has a height-adjustable table top, height adjustable shelves, and adjustable holders for care products and washing articles, for use as a baby changing table, and which may be reassembled for use as a desk for children or a partition, as defined in the claims enclosed.

DESCRIPTION OF EMBODIMENTS

A Baby Changing Table

Figure 1:
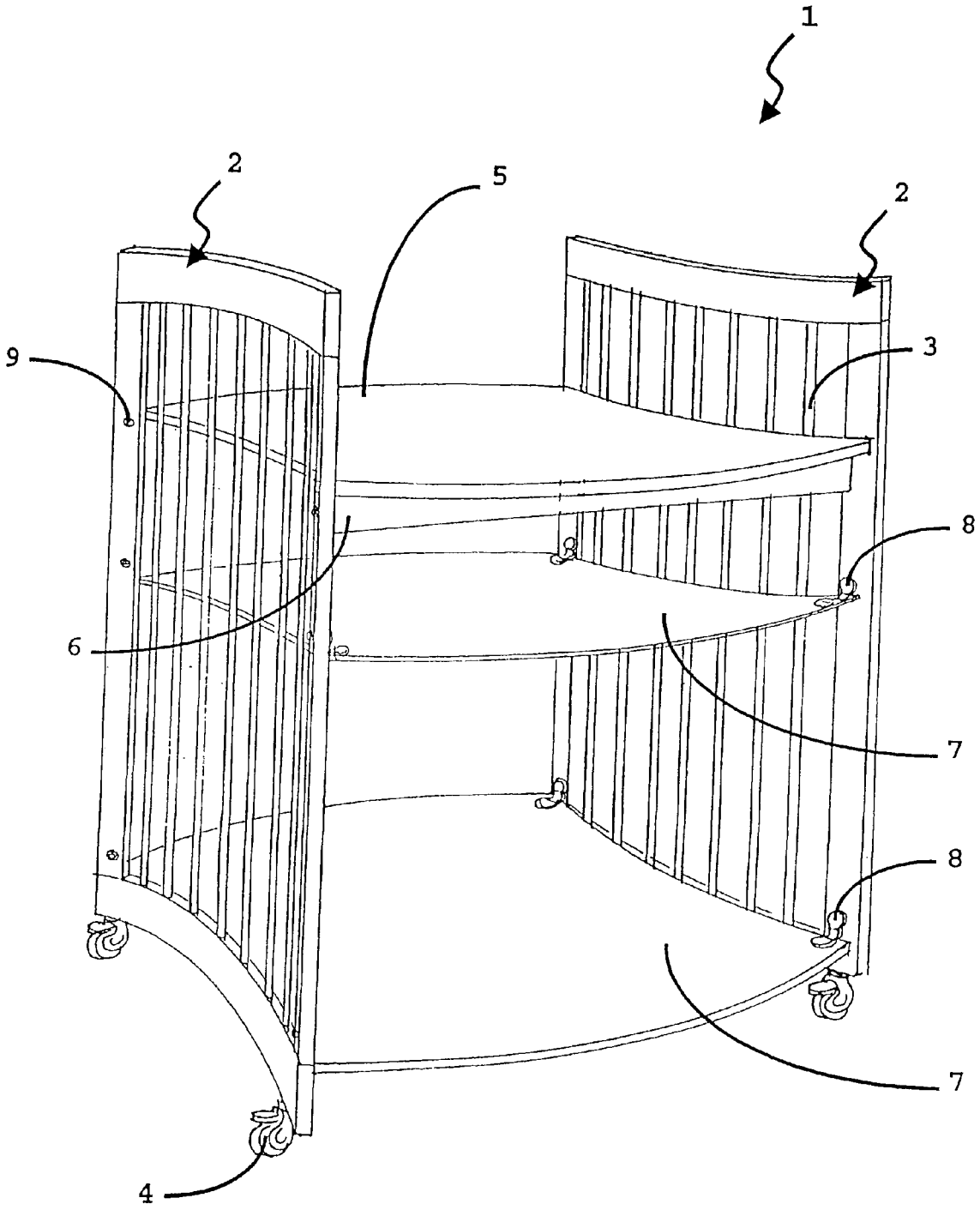
FIG. 1 depicts a perspective view of a combination table according to the invention with nursing plate and shelves.

The combination table 1 according to the invention is made up of to side members 2, symmetrically about a vertical longitudinal centre plane, which constitute the supporting sides of the table as shown in FIG. 1. The side members 2 are slightly arched in this embodiment, but may alternatively have another form or be planar. A side member 2 is constructed as a rectangular frame for example with bars 3 in the vertical direction to cover the side areas. The side members can be made of any suitable material such as wood, metal, plastic of combinations thereof. In the two lower corners of the side members 2, there may be mounted swivelling and lockable wheels 4 or legs. The table top 5 is height adjustably mounted to adapt to the users (the person who performs the baby changing) own height. The table top may be made of wood, plastic of any suitable material which may easily be cleaned and contains alternatively crossbeams 6 depending on the stiffness and strength of the table top 5 itself. The crossbeams 6 may be attaches to the side members' edges by regular through-holes 9 with bolts or similar fastening means. In use as a baby changing table, the table top 5 may alternatively be padded or preferably have a removable padded changing mat mounted (not shown).

Figure 2:
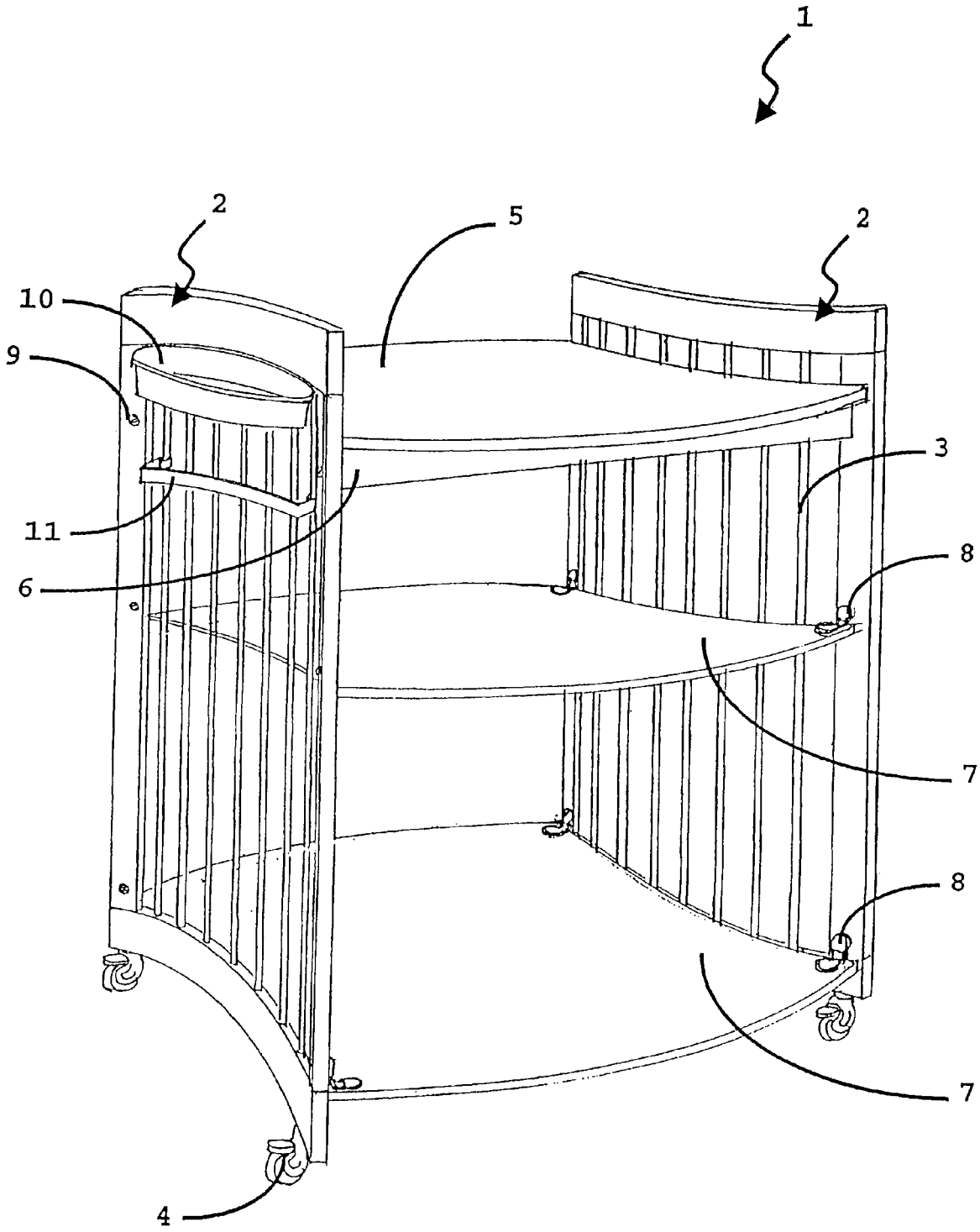
FIG. 2 depicts the combination table in FIG. 1 in another configuration with holders for articles and towels.

The shelves 7 are like the table top 5, mounted horizontally between the side members and are height adjustable, in order to adapt to the preferred working posture. The shelves 7 may be attached to the side members edges by angle armatures 8. FIG. 2 depicts such an alternative configuration of the baby-changing plate 5 and the shelves 7. The design of the shelves may vary, but they are preferably stiff in order to maintain their form during load and in order to reinforce the table. The longitudinal edges should be adapted in shape with the shape of the side members 2 for the same reason, such as a concave curvature in the embodiment depicted in the Figures. The transverse edges of the table top 5 and the shelves 7 may have other forms, such as convex in this embodiment. The number of shelves may be varied. The shelves 7 are solid in this embodiment, but may alternatively be made of a mesh material. The shelf or basket has then not necessarily any stiffening effect on the table and should then be mounted together with a crossbeam 12, for example centrally between the lower ends of the side members 2 (see below) or an extra shelf. A shelf of a material which is not solid may be useful for example in order to store bathing toys which need to dry, or to dry clothes which should be dried flat.

Article holders 10 and 11 may be mounted on the side members 2, and may be made in plastic with fastening means which are snapped onto the bars 3, or by fastening them by the same holes 9 in the side members 2 as the shelves and the table plate. The article holders 10 and 11 may be adjusted to the preferable height according to suitable working posture. The article holders may for example be formed as a bowl 10 for lotions, powder, cleaning wipes, thermometer, wash basin, basket for dirty clothes etc., or a towel holder 11 for drying towels, clothes etc., or as other practical holders which the user may have use for such as waste basket, paper holder or dispensers of different kinds (not shown).

A Desk

Figure 3:
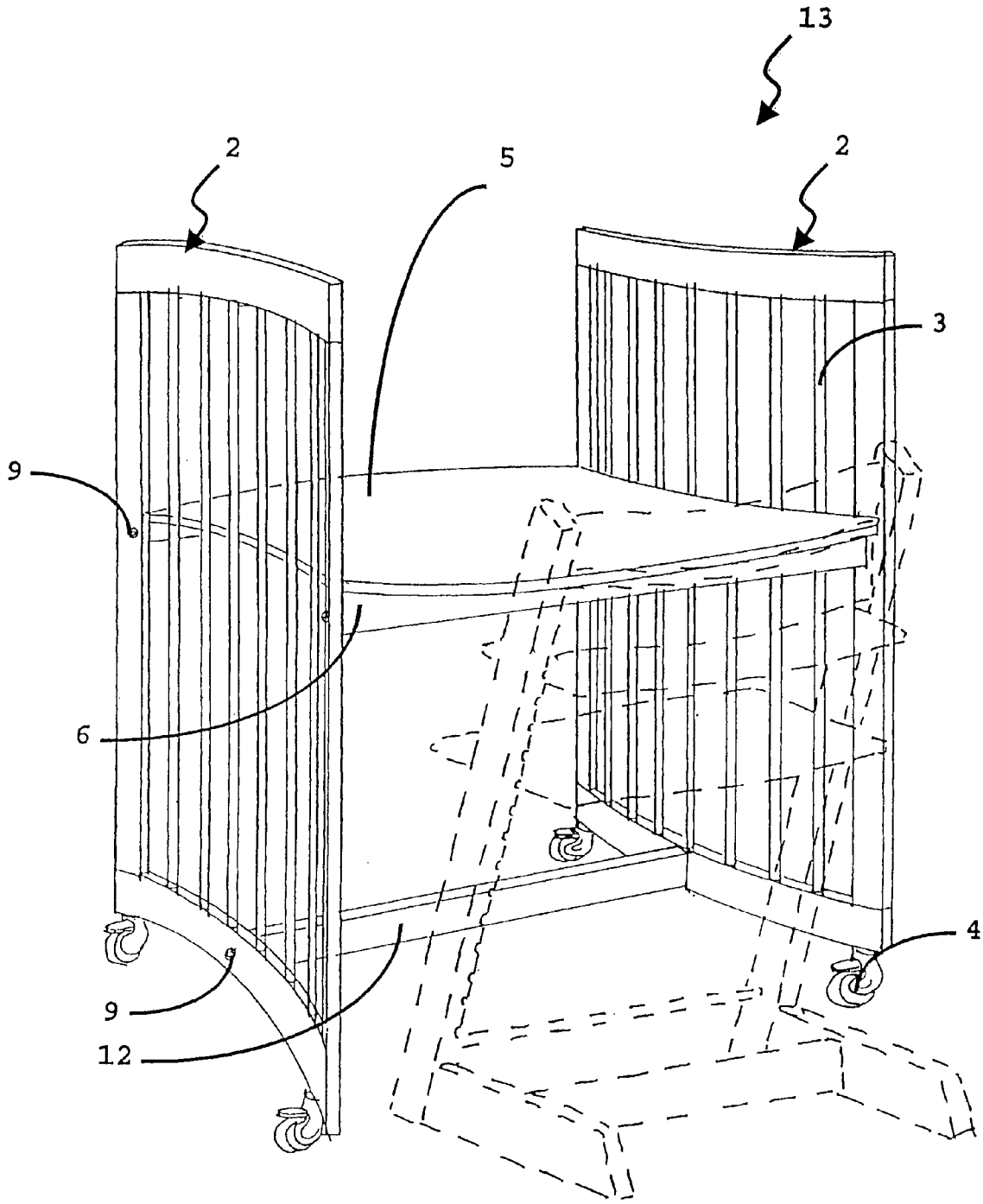
FIG. 3 depicts a perspective view of the combination table in FIG. 1 assembled as a desk.

When the child no longer needs the baby changing table 1, the table may in another embodiment be re-assembled to a writing or working desk 13 by replacing the lower shelf 7 with a crossbeam 12 and alternatively removing other shelves 7 in order to give room for the users legs and for a chair as shown in FIG. 3. The table top may also in this embodiment be adjusted in height to adapt to the child as it grows and should preferably be used together with a height adjustable chair such as a Tripp-Trapp® chair (dotted in FIG. 3). In this way, the working position of the child may be optimised while growing up.

Alternatively a suitable shelf 7 may be used as table plate, or a shelf 7 may be mounted right under table top 5 in order to give a storage room for example for writing/drawing articles.

Figure 5:
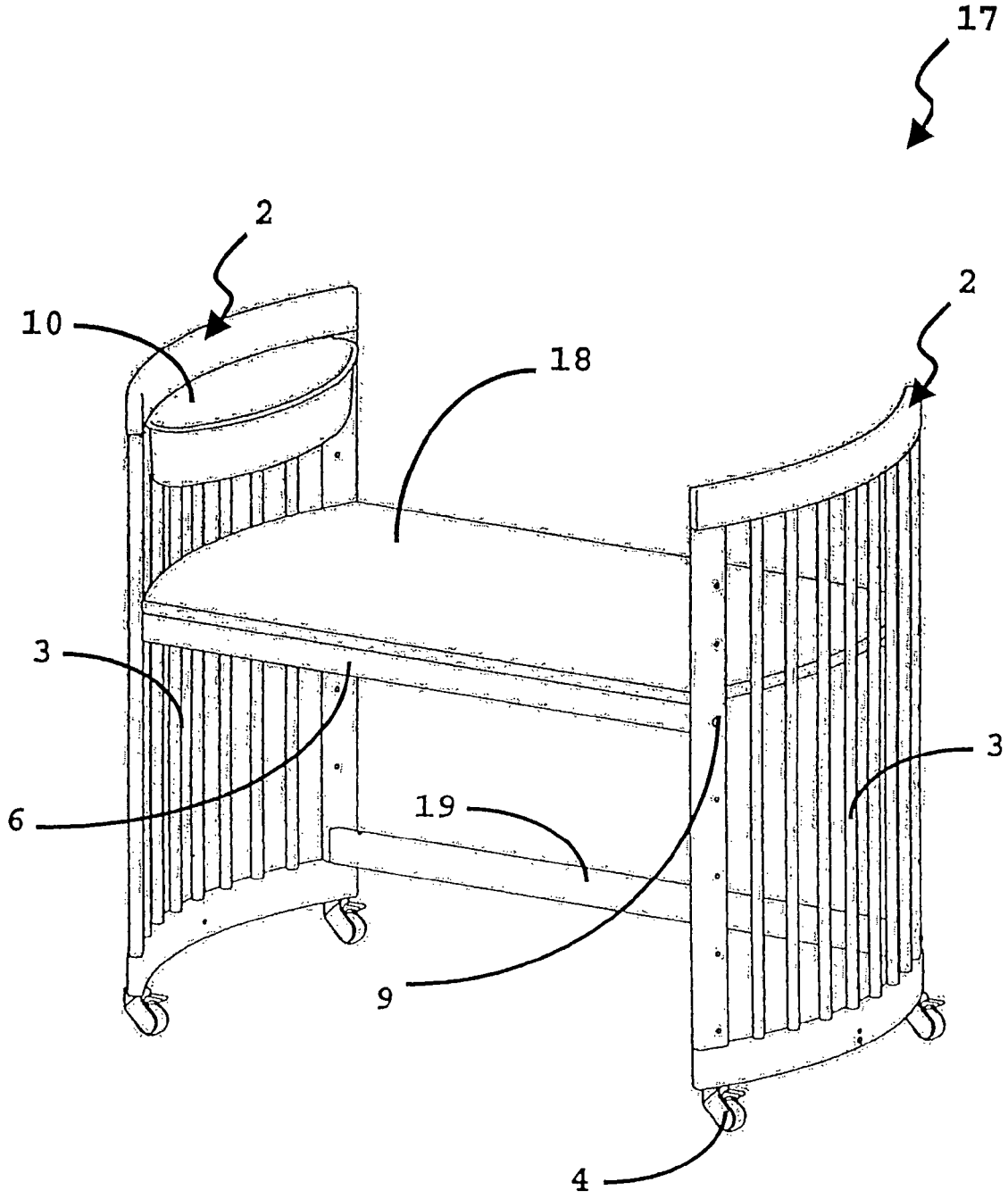
FIG. 5 depicts a perspective view of the combination table as an alternative desk.

An alternative desk 17 is shown in FIG. 5 wherein a somewhat longer table top 18 with convex edges which fit into the side members 2 on the opposite side of what is shown in the other figures. The advantage here is that the table space is larger. A somewhat longer crossbeam 19 is mounted between the rear lower corners of the side members 2 to give extra space for the users legs.

Alternatively the table may be used as a PC-table adapted to either children or adults, or the table top 5 may be mounted relatively low, together with a shelf 7 or a crossbeam 12 to achieve a play table (not shown). In the table embodiments above, the article holders 8 may likewise be attached at the desired height to hold articles such as writing articles, toys, disks, CD's etc.

Height adjustment of the table top 5 or the shelves 7 may be achieved by conventional systems such as rows of holes 9 in the edges of the side members 2, for through bolts which either directly are fastened to the table top 5, shelves 7 or crossbeams 6 or 12, or via an armature 8 as shown in the figures. It is important that the fastening and regulating system may only be operated by an adult, so that a child may not cause the table to collapse.

A Partition

Figure 4:
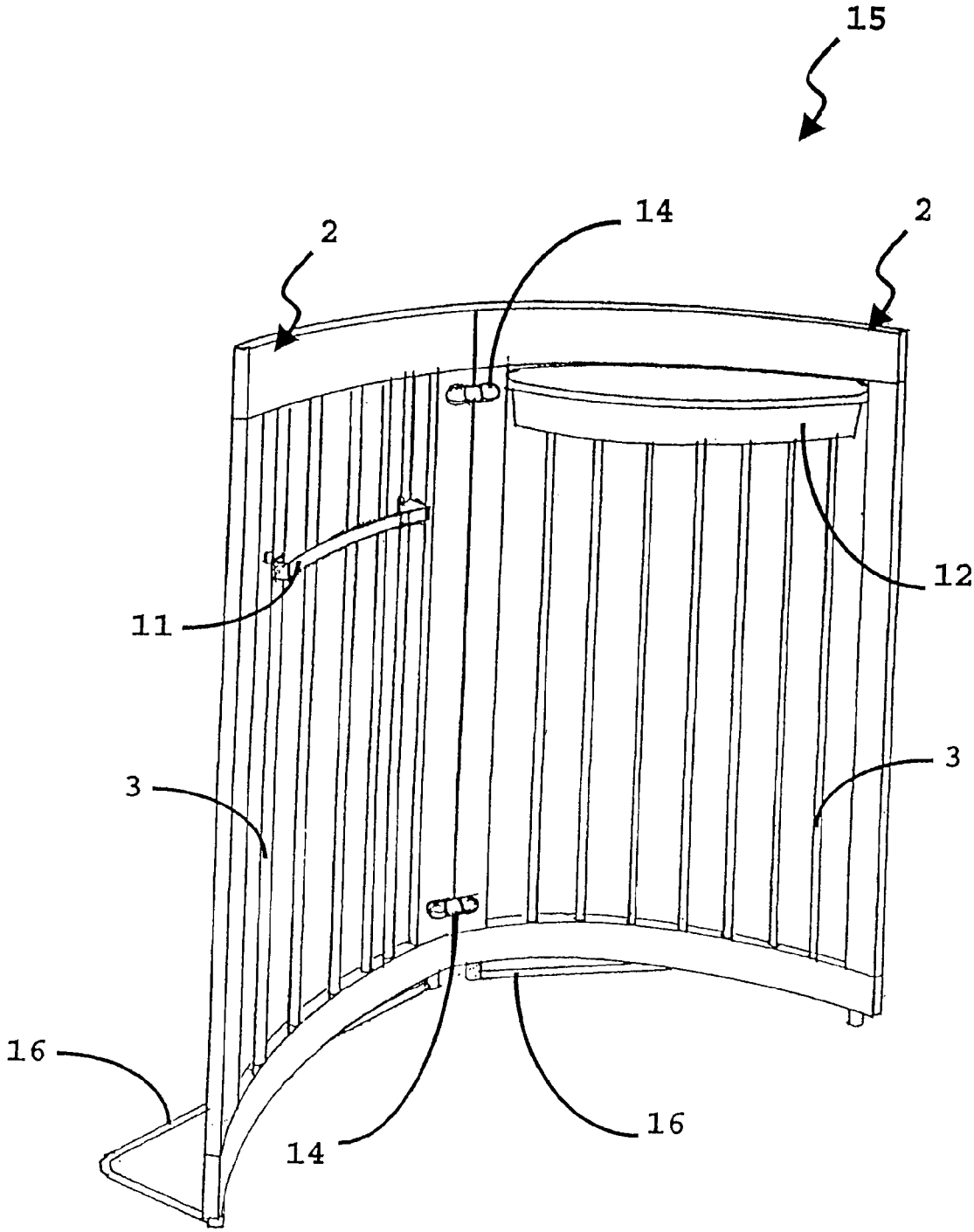
FIG. 4 depicts a perspective view of the combination table in FIG. 1 assembled as a partition.

In a third embodiment, the side members 2 of the table 1 may be mounted together in one of their vertical ends with an armature 14, for example a planar armature, to form a screen or partition 15 as shown in FIG. 4. In order to maintain stability and avoid tipping over, supportive legs or bows 16 may be mounted in the lower corners of the side member 2 instead of wheels 4. The side members 2 may in this embodiment be mounted such that they together either make up a segment of a cylinder as in FIG. 4, or an S-form, depending on the use. Alternatively the armature 14 may contain an angle, or an angle iron 8 may be used to mount the side members together so achieve other embodiments of the partition. Alternatively, a table top 5 or a shelf 7, for example with a covering or mesh design, may be mounted between the side members 2 edgewise, with the above mentioned armatures to make the partition longer and/or to obtain more angles (not shown). The partition may thereby have many different forms depending on the assembly. The partition 15 may be used as a partition for example if two children share a room, or divide a room into a sleeping and play/working section. Further, the partition may be used for play such as a puppet theatre, a house, or to cordon off areas to the child. The article holders 11 and 12, as mentioned earlier, may be mounted onto the partition 14 on the sides of the side members, and in desired height. If desired, the side members 2 may be covered with a dense or semi-dense material, such as fabric or a mesh, which may be stretched over the outer curvature of the wall, or in zigzag between the bars 3, if the partition 15 is to be used to divide a room for example.

The invention claimed is:

1. Combination table (1) arranged for interchangeable use as one of a baby changing table and a desk, the combination table consisting of:

exactly two vertical side members (2), each side member (2) including a rectangular frame with two vertical edges and an upper and a lower horizontal edge, with vertical bars extending between the upper and lower horizontal edges, wherein the upper and lower horizontal edges are concavely curved in the horizontal plane;

at least one horizontal table top (5) having two pairs of opposing sides, one pair of opposing sides being curved in the horizontal plane according to the curving of the side members, the table top configured to be fastened height adjustably between the side members at the corner ends of the curved sides of the table top via through holes (9) to the vertical edges of the side members;

at least one shelf (7) having two pairs of opposing sides, one pair of opposing sides being curved in the horizontal plane according to the curving of the side members, each shelf configured to be fastened height adjustably between the side members at the corner ends of the curved sides of the shelf to the vertical edges of the side members; and at least one horizontal crossbeam (6, 12, 19) configured to be fastened between the side members at its distal ends to opposing vertical edges of the side members;

wherein the combination table arranged as a baby changing table comprises the side members (2) placed reciprocally with their concave sides directed away from each other, a table top (5) and at least one shelf (5), each having opposing sides being concavely curved, fastened to the side members, with the at least one shelf (7) positioned under the table top (50);

wherein when the combination table is arranged as a desk, the side members (2) are placed reciprocally with their concave sides directed toward each other, a horizontal table top (5) having opposing curved sides being convexly curved is fastened to the side members (2), and a horizontal crossbeam (12) is fastened to opposing vertical edges of the side members supportingly beneath the horizontal table top (5); and wherein the corner ends of the curved sides of the table top and the at least one shelf (7) are supported only by the two vertical side members (2), so that both the table top and at least one shelf are accessible from the remaining pair of opposing sides at any height positions thereof and in either configuration of the combination table.

2. Combination table (1) according to claim 1, characterized in that one the height-adjustable table top (5) and at least one height-adjustable shelf (7) are mounted horizontally between the side members (2).

3. Combination table (1) according to claim 2, characterized in that one the cross beam (12) is mounted horizontally between the side members (2).

4. Combination table (1) according to claim 1, characterized in that one or more additional height-adjustable shelves (7) are mounted horizontally between the side members.

5. Combination table (1) according to claim 1, wherein a first pair of opposing sides of the table top (5) each define a concave curve; and/or the remaining pair of opposing sides of the table top (5) each define a convex curve.

6. Combination table (1) according to claim 1, wherein the vertical edges of side members (2) are furnished with rows of holes at different height position.

7. Combination table (1) according to claim 6, wherein the table top (5) is attached to said vertical edges either directly by through bolts or via an armature (8).

8. Combination table (1) according to claim 6, wherein said at least one shelf (7) is attached to said vertical edges either directly by through bolts or via an armature (8).

9. Combination table (1) according to claim 6, wherein said crossbeam (12) is attached to said vertical edges either directly by through bolts or via an armature (8).

10. Combination table (1) according to claim 1, wherein vertical edges of side members (2) are furnished with rows of holes at different height position, and the table top (5) is attached to said vertical edges either directly by through bolts or via an armature (8).

* * * * *